US007865102B2

(12) United States Patent
Nanataki et al.

(10) Patent No.: US 7,865,102 B2
(45) **Date of Patent: *Jan. 4, 2011**

(54) IMAGE FIXING APPARATUS

(75) Inventors: Hideo Nanataki, Yokohama (JP); Takashi Nomura, Numazu (JP); Kenji Takagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/535,826

(22) Filed: Aug. 5, 2009

(65) Prior Publication Data

US 2009/0297198 A1 Dec. 3, 2009

Related U.S. Application Data

(63) Continuation of application No. 12/179,077, filed on Jul. 24, 2008, now Pat. No. 7,599,637.

(30) Foreign Application Priority Data

Jul. 27, 2007 (JP) ..... 2007-195825
Jul. 11, 2008 (JP) ..... 2008-181505

(51) Int. Cl.
*G03G 15/20* (2006.01)

(52) U.S. Cl. ..... 399/70; 399/45; 399/334; 219/216

(58) Field of Classification Search ..... 399/33, 399/44, 45, 67, 69, 70, 330, 331, 333, 334; 219/216, 469–471
See application file for complete search history.

(56) References Cited

U.S. PATENT DOCUMENTS 5,758,228 A 5/1998 Hirose et al.
7,203,437 B2 4/2007 Kikuchi
2003/0190170 A1 10/2003 Hamada et al.
2005/0175367 A1 8/2005 Urabe
2005/0207773 A1 9/2005 Nakayama (Continued)

FOREIGN PATENT DOCUMENTS

JP 7-160143 6/1995

(Continued)

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

A fixing apparatus includes a control circuit which controls the electrifying to a first heater so that a temperature detected by a first temperature detection portion reaches a first target temperature and controls the electrifying to a second heater so that a temperature detected by a second temperature detection portion reaches a second target temperature, when warm-up is initiated, and, when the warm-up initiated, if an initial temperature of a rotary member is below a predetermined temperature, the control circuit sets the first target temperature to a temperature value greater than the first target temperature set when the initial temperature of the rotary member is greater than the predetermined temperature and sets the second target temperature to a temperature value greater than the second target temperature set when the initial temperature of the rotary member is greater than the predetermined temperature. In this way, hot offset and poor fixing can be prevented and a pre-heating operation time can be prevented from extending excessively.

6 Claims, 9 Drawing Sheets

U.S. PATENT DOCUMENTS

2006/0062585 A1 3/2006 Sone et al.

FOREIGN PATENT DOCUMENTS

JP 10-26901 1/1998
JP 11-125991 5/1999
JP 2002-174989 6/2002
JP 2004-341398 12/2004
JP 2006-11120 1/2006

IMAGE FIXING APPARATUS

This application is a continuation of application Ser. No. 12/179,077, filed Jul. 24, 2008 now U.S. Pat. No. 7,599,637.

BACKGROUND OF THE INVENTION

1. Field of the Invention

The present invention relates to a fixing apparatus mounted to an image forming apparatus.

2. Related Background Art

An example of a conventional image forming apparatus will now be described with reference to an electro-photographic printer.

In the electro-photographic printer, an image forming operation is performed as follows. First of all, a surface of a photosensitive member having a photosensitive layer is uniformly electrified or charged and then, the photosensitive member is exposed in accordance with an image signal sent from a host computer, thereby forming a latent image. Then, after the latent image is developed as a visual image by developer (toner), the visual image (toner image) is transferred onto a recording material, and then, the toner image together with the recording material is passed through a fixing apparatus to thermally fix the toner image, thereby forming a fixed image. In general, some of fixing apparatuses includes a heater as a heat source, a rotary member heated by the heater, a pressure member that contacts with the rotary member to form a nip portion therebetween, a temperature detection portion for detecting a temperature of the heater, and control means for controlling the electrifying to the heater.

In the fixing apparatus, the temperature of the rotary member must be increased to heat the recording material adequately, thereby preparing a fixing operation. More specifically, after the temperature of the rotary member is increased up to a predetermined temperature, the fixing operation is carried out. Hereinafter, an operation by which the temperature of the rotary member is previously increased to heat the recording material is referred to as a pre-heating operation. In the fixing apparatus in which the pre-heating operation is performed, it is desirable that the fact that the temperature of the rotary member reaches the predetermined temperature (target temperature) utilizes a condition for the ending of the pre-heating operation, i.e. the starting of the image formation.

On the assumption that the pre-heat is performed from a low temperature condition, it is desirable to set the target temperature to a higher value, supposing that the heat is dispersed from the fixing apparatus. However, in a case where the temperature around the fixing apparatus is high, if the target temperature is set to the higher value, excessive heat would be supplied, thereby arising problems that an image problem such as hot offset is generated and/or that the pre-heating operation time is extended excessively.

Japanese Patent Application Laid-open No. H10-26901 (1998) discloses an arrangement in which, to cope with the variation of a surrounding environment of the image forming apparatus, on the basis of the temperature of the rotary member prior to the heating (referred to as "initial temperature" hereinafter), the target temperature is set to a low value if the initial temperature is high and the target temperature is set to a high value if the initial temperature is low.

However, in the arrangement disclosed in the Japanese Patent Application Laid-open No. H10-26901, when the fixing operation is performed after the pre-heating operation is finished, since a temperature of a central region of the rotary member reaches a temperature enough to heat the recording material adequately but temperatures of end-portions of the rotary member do not reach such a temperature, poor fixing may be generated at end-portions of the recording material. Further, when the temperatures of the end-portion regions of the rotary member reach the temperature enough to heat the recording material adequately, the temperature of the central region of the rotary member is increased excessively, which may cause the hot offset.

Japanese Patent Application Laid-open No. 2002-174989 discloses a fixing apparatus comprising a central region heater for heating a central region of a rotary member, an end-portion region heater for heating an end-portion region of the rotary member, a main-thermistor for detecting a temperature of the central region of the rotary member, a sub-thermistor for detecting a temperature of the end-portion region of the rotary member and wherein the electrifying to the central region heater is controlled on the basis of a detected temperature of the main-thermistor and the electrifying to the end-portion region heater is controlled on the basis of detected temperature of the sub-thermistor. When the central region heater and the end-portion region heater are heated so that the main-thermistor and the sub-thermistor reach target temperatures respectively, if a difference between the temperature detected by the main-thermistor and the temperature detected by the sub-thermistor exceeds a predetermined temperature difference, the temperature of the heater heating the higher temperature region is further increased and the temperature of the heater heating the lower temperature region is decreased, thereby making longitudinal temperature distribution of the rotary member uniform.

However, in the arrangement disclosed in the Japanese Patent Application Laid-open No. 2002-174989, although the uniformity during the fixing operation can be achieved by providing the plurality of heaters and thermistors, in this arrangement, also in the pre-heating operation, it is designed that the main-thermistor and the sub-thermistor reach the target temperature regardless of the initial temperature. Thus, in the arrangement disclosed in the Japanese Patent Application Laid-open No. 2002-174989, since the target temperatures of the main-thermistor and the sub-thermistor are set to the same temperature until the difference between the temperature detected by the main-thermistor and the temperature detected by the sub-thermistor reaches the predetermined temperature difference, the pre-heating operation time may extended excessively.

The present invention is made in consideration of the above-mentioned circumstances and aims to provide a fixing apparatus in which a pre-heating operation time is not extended excessively, while maintaining longitudinal temperature distribution of a rotary member to temperature distribution which does not cause poor fixing and/or hot offset when a fixing operation is carried out after a pre-heating operation is finished regardless of an initial temperature of the rotary member.

SUMMARY OF THE INVENTION

The present invention is made in consideration of the above-mentioned problems, and an object of the present invention is to provide a fixing apparatus in which a pre-heating operation time is not extended excessively, while maintaining longitudinal temperature distribution of a rotary member to temperature distribution which does not cause poor fixing and/or hot offset when a fixing operation is carried out after a pre-heating operation is finished regardless of an initial temperature of the rotary member.

Another object of the present invention is to provide an image fixing apparatus for fixing an image formed on a recording material, including a rotary member that contacts with a recording material bearing an image; a first heater provided in said rotary member, wherein a heat generation amount per unit length at a central region of said first heater in a longitudinal direction is greater than a heat generation amount at end regions of said first heater in a longitudinal direction; a second heater within said rotary member, wherein a heat generation amount per unit length at end regions of said second heater in a longitudinal direction is greater than a heat generation amount of said second heater at a central region in a longitudinal direction; a pressure roller that forms a nip portion to pinch and convey the recording material with said rotary member, wherein the image on the recording material is heat-fixed onto the recording material by heating the image at the nip portion; a first temperature detection portion that detects a temperature of a longitudinal central region of said rotary member; a second temperature detection portion for detecting a temperature of said rotary member corresponding to a non-sheet-feeding region when a recording material having a predetermined maximum width is fed; and a control circuit for controlling the electrifying to said first heater and said second heater; wherein when said apparatus starts warming up, said control circuit controls the electrifying to said first heater so that the temperature detected by said first temperature detection portion reaches a first target temperature and controls the electrifying to said second heater so that the temperature detected by said second temperature detection portion reaches a second target temperature; and wherein, if an initial temperature of said rotary member is below a predetermined temperature when said apparatus starts warming up, said control circuit controls said first target temperature to a temperature value greater than the first target value set when the initial temperature of said rotary member is greater than said predetermined temperature and controls said second target temperature to a temperature value smaller than the second target temperature set when the initial temperature of said rotary member is greater than said predetermined temperature.

A still further of the present invention will become apparent from the following description of exemplary embodiments with reference to the attached drawings.

DESCRIPTION OF THE EMBODIMENTS

Figure 1:
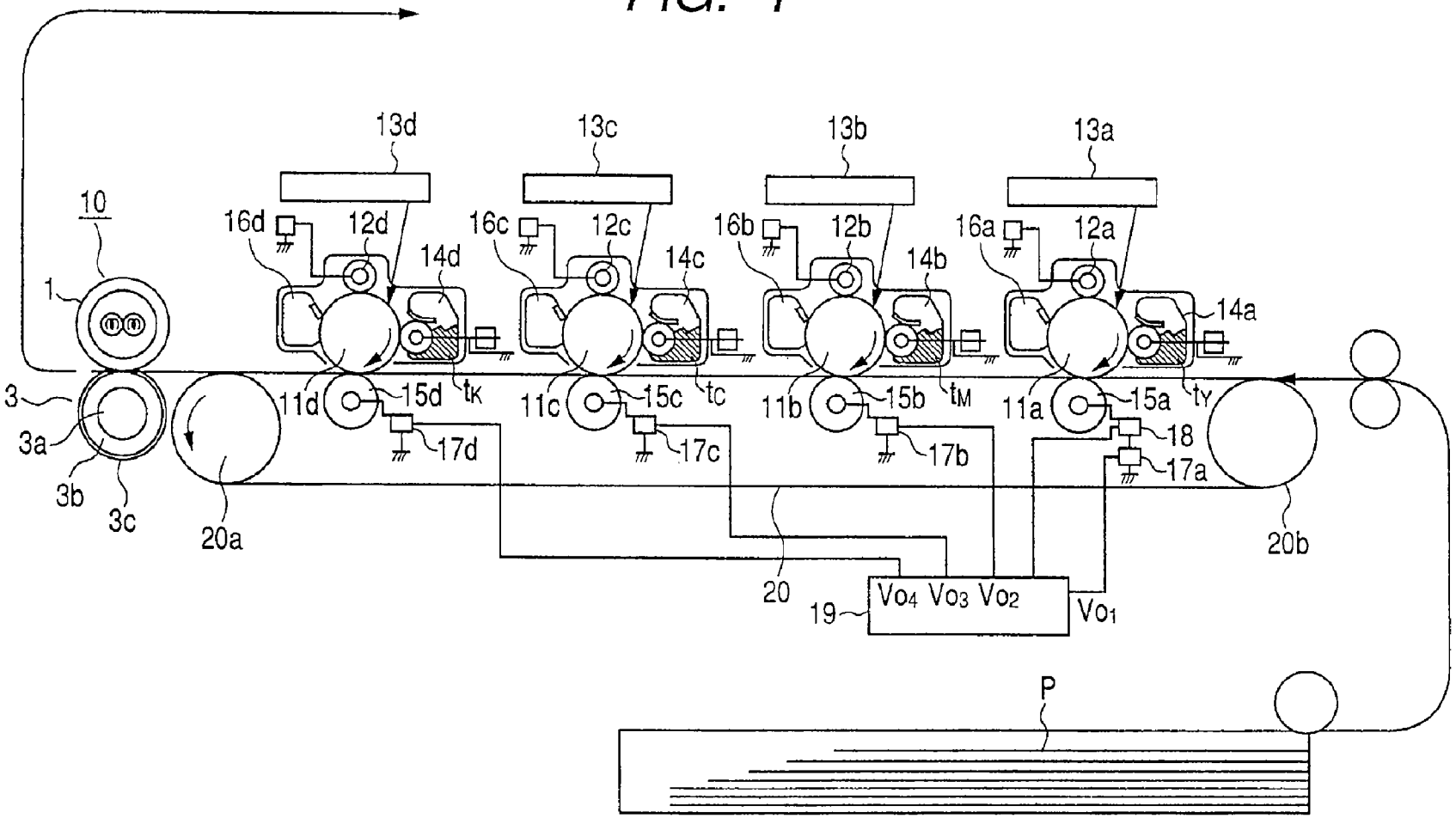
FIG. 1 is a schematic constructional sectional view showing an example of an image forming apparatus according to a first embodiment of the present invention.

(1) Image Forming Apparatus (FIG. 1)

FIG. 1 is a schematic constructional sectional view showing an example of an image forming apparatus. The image forming apparatus according to an illustrated embodiment is an in-line electro-photographic full-color printer which can obtain 200 full-color images of A3 size per minute.

In this arrangement, as photosensitive members, photosensitive drums 11*a*, 11*b*, 11*c* and 11*d* (hereinafter, denoted by 11*a*-11*d*) corresponding to yellow, magenta, cyan and black color toners respectively are provided. A transfer belt 20 is contacted with the photosensitive drums 11*a*-11*d* at their respective transferring portions (shown by I, II, III and IV in order).

To give resistance to the transfer belt 20, a transfer belt having a thickness of 0.1 mm and specific volume resistance adjusted to 108Ω·cm by dispersing carbon into polyimide resin is used.

In the respective transferring portions I-IV, transfer rollers 15*a*-15*d* each obtained by coating an elastic material having intermediate resistance (actual resistance at a nip portion is 106-1010Ω when voltage of 500 V is applied) on a metal core are arranged in a confronting relationship to the photosensitive drums 11*a*-11*d* to pinch the transfer belt 20 therebetween.

Incidentally, primary chargers are denoted by 12*a*-12*d*, scanners are denoted by 13*a*-13*d*, developing devices are denoted by 14*a*-14*d*, cleaning devices are denoted by 16*a*-16*d* and power sources are denoted by 17*a*-17*d*. The reference numeral 18 denotes a current detection circuit, 20*a* denotes a drive roller and 20*b* denotes a driven roller. Yellow, magenta, cyan and black color toners (developers) are denoted by $t_Y$, $t_M$, $t_C$ and $t_K$. A recording material is denoted by P. Further, the reference numeral 10 denotes a fixing apparatus which will be described in "(3) Fixing apparatus" hereinbelow.

(2) Image Forming Operation

The photosensitive drum 11*a* is rotated in a direction shown by the arrow in FIG. 1 and is uniformly charged by the primary charger 12*a*. An image data sent from a host computer is converted into laser luminous intensity and time by image data processing, and a laser light beam from the scanner 13*a* forms an electro-static latent image on the photosensitive drum 11*a*. Intensity and an illumination spot diameter of the laser light beam are properly set on the basis of resolution and desired image density of the image forming apparatus. In the electro-static latent image formed on the photosensitive drum 11*a*, a portion of the latent image illuminated by the laser light beam is formed to have bright portion potential VL (about −100 V) and the other portion is formed to have dark portion potential VD (about −700 V) charged by the primary charger 12*a*. By the rotation of the photosensitive drum 11*a*, the electro-static latent image is moved to be opposed to the developing device 14*a*, where the toner charged to have the same polarity (negative polarity in the illustrated embodiment) is supplied to the latent image, thereby visualizing the latent image as a toner image. In a full-color image formation, regarding the photosensitive drums 11*a*-11*d* corresponding to the respective colors, toner images are formed similarly, and the toner images are successively transferred onto the recording material P conveyed by the transfer belt 20 at respective transfer nip portions, thereby forming a composite toner image. In each of the respective transfer nip portions defined by the transfer belt 20 and the photosensitive drums 11*a*-11*d*, the toner image is transferred by an electric field generated at each transfer nip portion by voltage having polarity opposite to that of the toner and applied to each of the transfer rollers 15*a*-15*d*. At a time when the recording material P is passed through the transfer nip portion regarding the photosensitive drum 11*d*, a full-color image is born on the recording material P. In this way, the transferring operation is finished.

On the other hand, after the toner images are transferred, surfaces of the photosensitive drums 11*a*-11*d* are cleaned by the cleaning devices 16*a*-16*d*, respectively, thereby preparing for next image formation. Voltages (transfer voltages) to be supplied to the transfer rollers 15*a*-15*d* are determined as follows. That is to say, before the recording material P is supplied, current obtained when predetermined voltage is applied to the transfer roller 15*a* is measured by the current detection circuit 18, and resistance of the transfer member (transfer roller 15*a* and transfer belt 20) is determined by a calculating operation by means of the control device 19 ($Vo_1$, $Vo_2$, $Vo_3$ and $Vo_4$). By this control, variation in resistance of the transfer member caused by an environment where the transfer member is disposed (particularly, moisture absorption) is absorbed, with the result that constant transfer charges can be supplied, thereby maintaining a stable image quality.

After the transferring operation is finished, the recording material P is separated from the transfer belt 20 by the curvature of the drive roller 20*a* and then is sent to the fixing apparatus 10, where the recording material is heated and pressurized, thereby obtaining a permanently fixed image.

(3) Fixing Apparatus 10

Figure 2:
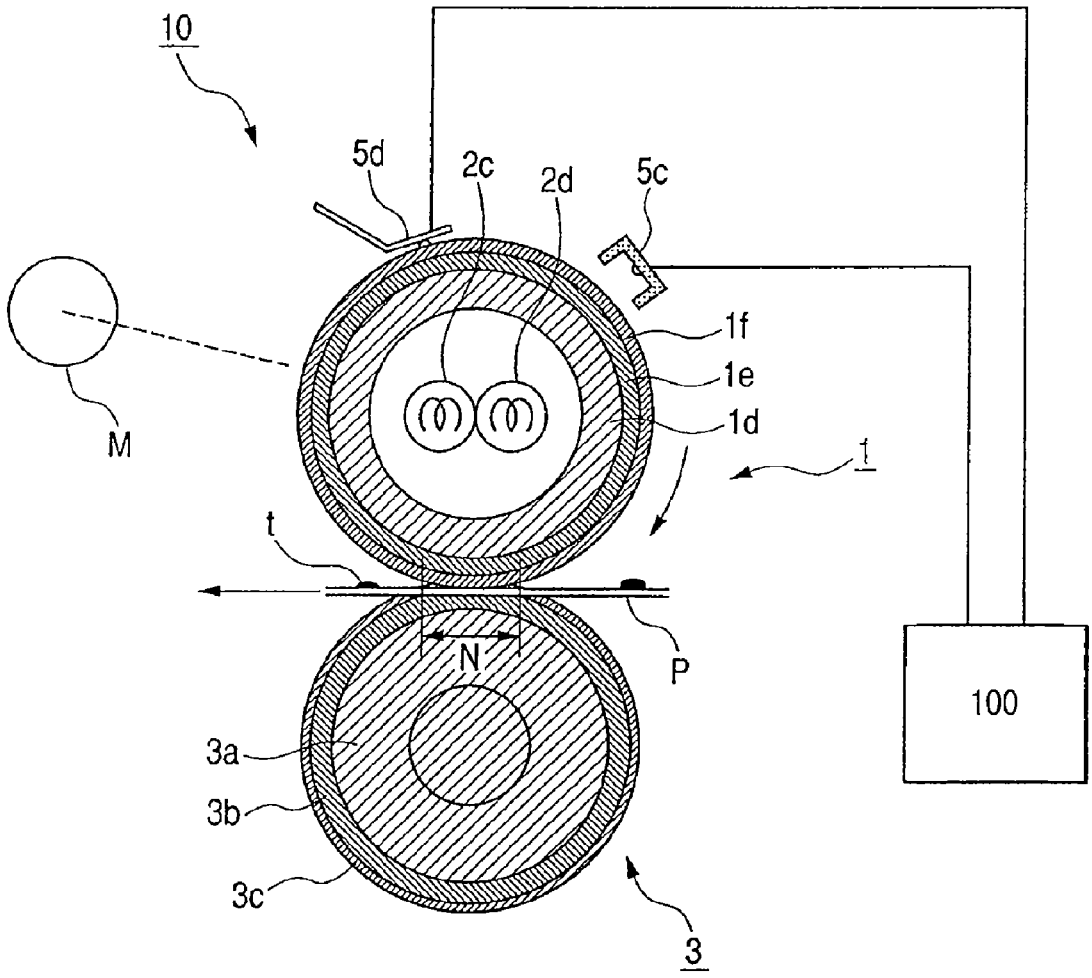
FIG. 2 is a side model view, partially in section, of a fixing apparatus according to a first embodiment of the present invention.

FIG. 2 is a side model view, in partial section, of the fixing apparatus 10. Incidentally, the recording material is denoted by P, a drive motor (drive means) for driving the fixing roller 1 is denoted by M, the toner is denoted by t, and a fixing nip portion is denoted by N.

Regarding the fixing roller 1 as a rotary member, silicone rubber having a thickness of 2.1 mm (and having heat transfer coefficient of 0.6 W/m/K) is coated on a hollow metal core 1*d* made of iron and having a thickness of 1.5 mm to form an elastic layer 1*e*, and a tube comprised of PFA resin having a thickness of 50 μm is provided on the elastic layer, thereby obtaining the fixing roller having a diameter of 50 mm. A pressure roller 3 as a pressure member is urged against the fixing roller 1 with pressure of about 700 N, thereby forming the fixing nip portion N therebetween. Regarding the pressure roller 3, silicone rubber having a thickness of 3 mm is coated on an iron metal core 3*a* having a diameter of 24 mm to form an elastic layer 3*b*, and a surface layer 3*c* is formed by a PFA tube having a thickness of 50 μm.

The fixing roller 1 includes two halogen heaters as heaters therein, and, in this case, a main-heater 2*c* (heater other than auxiliary heat sources) is a heater disposed at a central region and having an output of 500 W and designed to afford 90% of a heat generation amount to a region having a width of 200 mm. The main-heater 2*c* mainly serves to heat a longitudinal main-portion of the rotary member. The other sub-heater 2*d* is a heater having an output of 300 W and designed to afford 90% of a heat generation amount to regions having a width of 70 mm at both end-portions. The sub-heater mainly serves to heat longitudinal both end-portions of the rotary member. These heaters can be driven independently and outputs thereof are adjusted by a control circuit (control means) 100.

Figure 3:
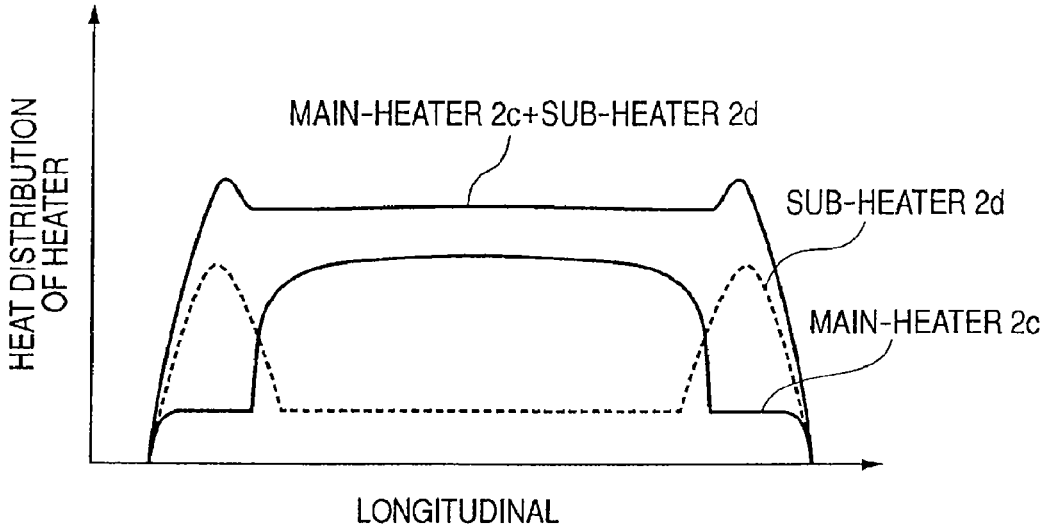
FIG. 3 is a view showing heat generation distribution when same voltages are applied to a main-heater and a sub-heater of the fixing apparatus according to the first embodiment of the present invention.

Incidentally, in the illustrated embodiment, the longitudinal main-portion of the rotary member is a longitudinal central region. More specifically, the longitudinal main-portion is at least a region including all of a region (sheet-feeding region) through which the recording material is fed when a recording material having a predetermined minimum width which can be fed (length along a direction perpendicular to a conveying direction of the recording material) is conveyed to the fixing apparatus 10 in the image forming apparatus. The longitudinal end-portions of the rotary member according to the illustrated embodiment are regions (non-sheet-feeding regions) through which the recording material is not fed when a recording material having a maximum width which can be fed in the image forming apparatus. Heat generation distributions of the heaters along the longitudinal direction of the rotary member obtained when the same voltages are supplied to the main-heater and the sub-heater according to the illustrated embodiment via the control circuit 100 is shown in FIG. 3.

Figure 4:
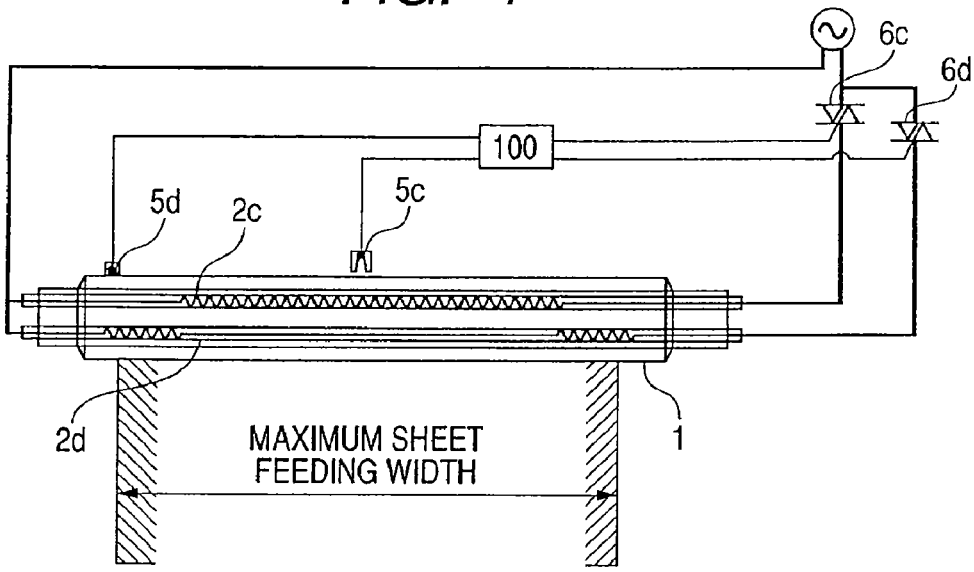
FIG. 4 is a schematic view showing a relationship between longitudinal heaters and temperature detection portions of the fixing apparatus according to the first embodiment of the present invention.

A thermo-pile or a first temperature detection portion 5*c* serves to detect the temperature of the central region of the fixing roller 1 and is disposed in a confronting relationship to the fixing roller 1 in a non-contact condition. A thermistor or a second temperature detection portion 5*d* serves to detect the temperatures of the end-portion regions of the fixing roller 1 and abuts against the fixing roller 1 at regions outside of the maximum width of the recording material which can be fed. FIG. 4 shows a schematic view of a fixing apparatus according to a first embodiment of the present invention in a longitudinal direction. The thermo-pile 5*c* and the thermistor 5*d* are connected to the control circuit 100 via signal lines, respectively, and, fundamentally, the thermo-pile 5*c* is referred to control for the main-heater 2*c* and the thermistor 5*d* is referred to control for the sub-heater 2*d*. A TRIAC 6*c* is a drive member which can switch electric power supplying to the main-heater 2*c* between an electrifying condition and a non-electrifying condition by the control circuit 100. A TRIAC 6*d* is a drive member which can switch electric power supplying to the sub-heater 2*d* between an electrifying condition and a non-electrifying condition by the control circuit 100.

Figure 5:
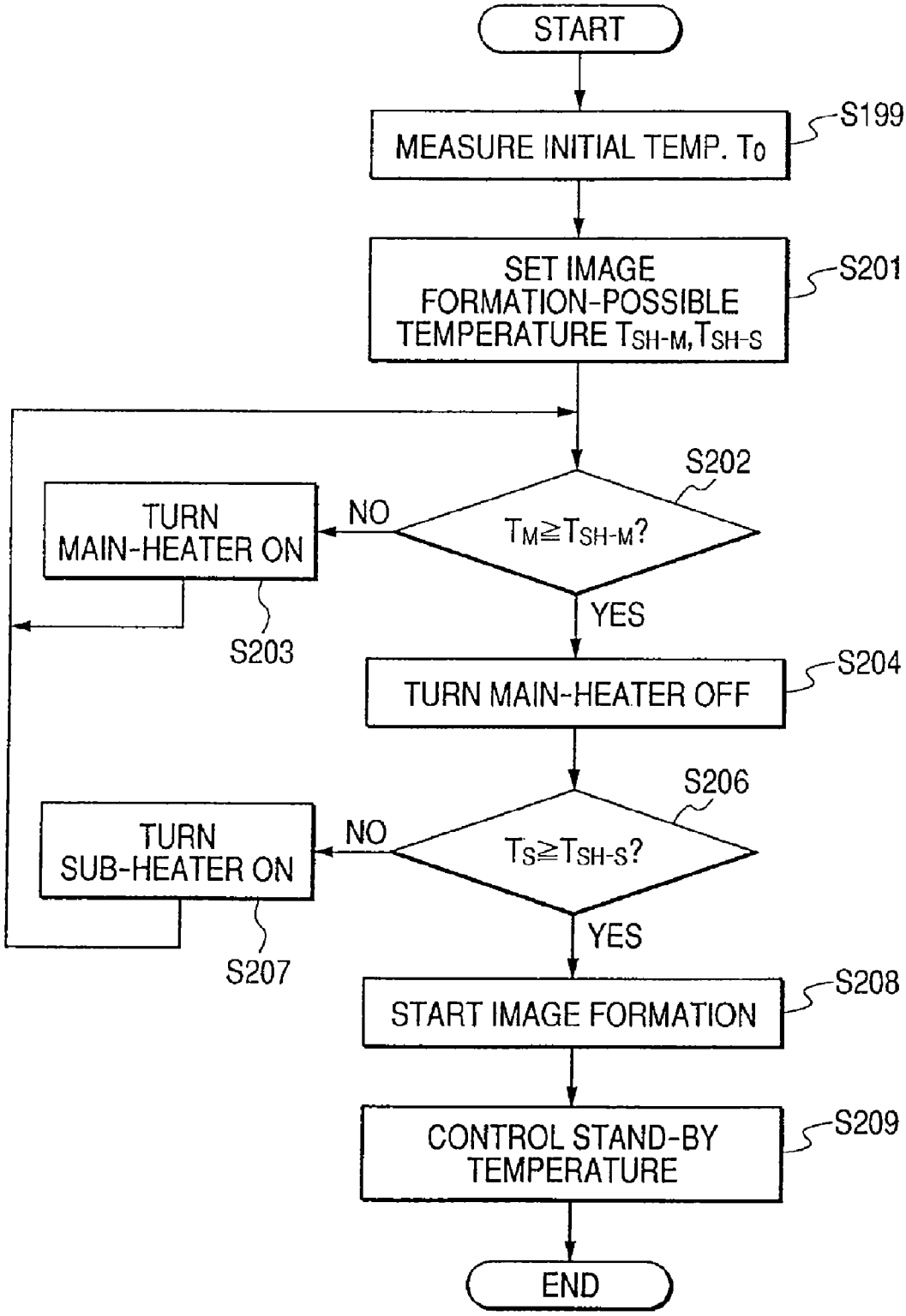
FIG. 5 is a flow chart for explaining an image formation preparing sequence according to the first embodiment of the present invention.

(4) Image Forming Preparation (FIG. 5)

In the illustrated embodiment, the fixing apparatus is constructed by using the roller having a large heat capacity, and, thus, a pre-heating operation is required.

The pre-heating operation according to the illustrated embodiment is an operation by which the temperature of the rotary member is previously increased to heat the recording material adequately. The pre-heating operation according to the illustrated embodiment is finished at a time when both of the temperatures detected by the thermo-pile 5*c* and the thermistor 5*d* reach target temperatures. After the pre-heating operation is finished, stand-by temperature adjustment for maintaining the temperature of the rotary member is performed so that the image formation can be started immediately.

In the illustrated embodiment, since the fixing roller 1 is heated by using two heaters having different heat generation distributions, even when the pre-heating operation is performed, the characteristic in which the longitudinal main-portion and the longitudinal end-portions of the rotary member can be heated independently is provided.

FIG. 5 is a flow chart showing the pore-heating operation for the image forming preparation. Before the pre-heating operation is started, the temperature of the rotary member is detected by the thermo-pile 5*c* and the detected temperature is determined as an initial temperature $T_0$ (step S199; hereinafter, "step" is omitted). On the basis of the initial temperature $T_0$, image formation permitting temperatures (target temperatures) for the thermo-pile 5*c* and the thermistor 5*d* are altered, respectively (S201). Concretely, if the initial temperature $T_0$ is below 120° C. (predetermined temperature), the control circuit 100 sets the image formation permitting temperature $T_{SH-M}$ (main-portion target temperature) for the thermo-pile 5*c* to 190° C. and the image formation permitting temperature $T_{SH-S}$ (end portion target temperature) for the thermistor 5*d* to 140° C. That is to say, the control circuit sets the first target temperature to 190° C. and the second target temperature to 140° C. On the other hand, if the initial temperature $T_0$ is greater than 120° C., the control circuit 100 sets the image formation permitting temperature $T_{SH-M}$ (main-portion target temperature) for the thermo-pile 5*a* to 175° C. and the image formation permitting temperature $T_{SH-S}$ (end portion target temperature) for the thermistor 5*b* to 150° C. That is to say, the control circuit sets the first target temperature to 175° C. and the second target temperature to 150° C.

If the detected temperature $T_M$ of the main-heater 2*c* detected by the thermo-pile 5*c* is below the image formation permitting temperature $T_{SH-M}$ (No in S202), the main-heater 2*c* is turned ON (S203). Then, when the detected temperature $T_M$ of the thermo pile 5*c* reaches the image formation permitting temperature $T_{SH-M}$ (Yes in S202), the electrifying to the main-heater 2*c* is stopped (OFF) (S204). Then, until the detected temperature $T_S$ of the sub-heater 2*d* detected by the thermistor 5*d* reaches the image formation permitting temperature $T_{SH-S}$ (No in S206), the sub-heater 2*d* is maintained to ON (S207), thereby continuing the image formation preparing operation. If the detected temperature $T_S$ of the sub-heater 2*d* reaches the image formation permitting temperature $T_{SH-S}$, it is stopped electrifying the sub-heater 2*d*. At a time when the detected temperatures of the thermo-pile 5*c* and the thermistor 5*d* reach the image formation permitting temperatures, respectively (Yes in S206), the image formation is started (S208), and, after the image formation is finished, stand-by temperature adjustment is performed (S209). In this embodiment, as long as the pre-heating operation is finished at each time when each of the temperatures of the thermo-pile 5*c* and the thermistor 5*d* respectively reaches each of the image formation permitting temperatures, the requirement is satisfied. That is, the flow sequence of the pre-heating operation in this embodiment is not restricted to the flow disclosed in FIG. 5. For example, it is allowed that the main-heater 2*c* and the sub-heater 2*d* are simultaneously electrified and it is respectively stopped electrifying the main-heater 2*c* and the sub-heater 2*d* at each time when each of the temperatures of the thermo-pile 5*c* and the thermistor 5*d* reaches each of the image formation permitting temperatures.

The pre-heating operation according to the illustrated embodiment is performed not only upon ON of the power source but also at a restoring operation after jam (poor conveying) treatment and/or replacement of a worn part such as the photosensitive drum. In the restoring operation, if the rotary member already had the high temperature, the image formation permitting temperatures are set again in S201.

Figure 6:
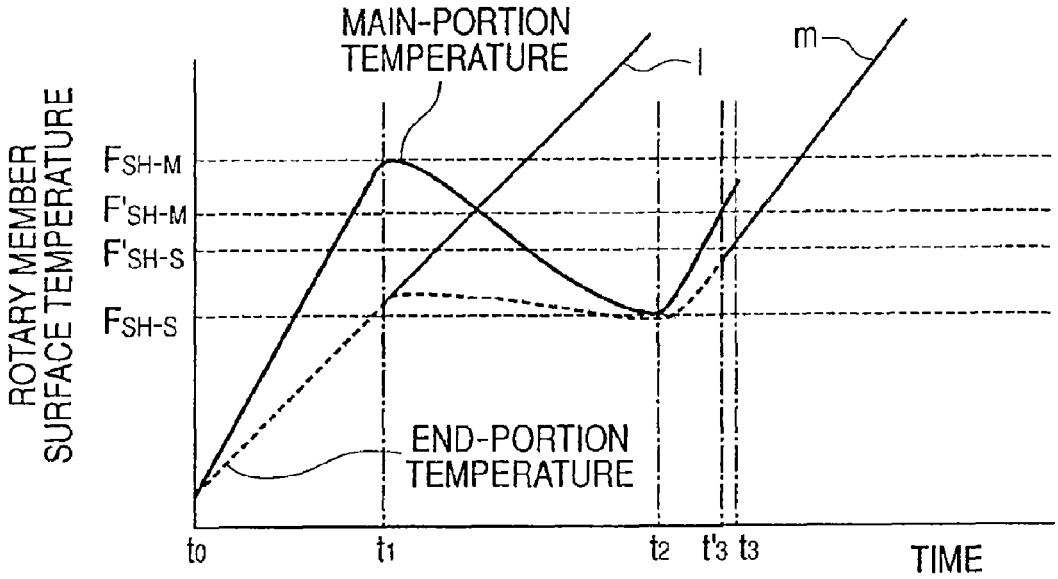
FIG. 6 is a view showing a temperature variation in a rotary member of the fixing apparatus according to the first embodiment of the present invention.

FIG. 6 is a view showing a temperature variation in the rotary member 1*f* of the fixing apparatus 10 used in the illustrated embodiment. Here, the temperature of the main-portion of the rotary member is a temperature (solid line) detected by the thermo-pile 5*c* and the temperature of the end-portion of the rotary member is a temperature (broken line) detected by the thermistor 5*d*. In FIG. 6, when the initial temperature $T_0$ is low, the image formation permitting temperature $T_{SH-M}$ of the thermo-pile 5*c* is denoted by $F_{SH-M}$ and the image formation permitting temperature $T_{SH-S}$ of the thermistor 5*d* is denoted by $F_{SH-S}$. On the other hand, when the initial temperature $T_0$ is high, the image formation permitting temperature $T_{SH-M}$ of the thermo-pile 5*c* is denoted by $F'_{SH-M}$ and the image formation permitting temperature $T_{SH-S}$ of the thermistor 5*d* is denoted by $F'_{SH-S}$.

During a temperature increasing operation from a room temperature corresponding to time $t_0$), although the temperatures of both of the main-portion and the end-portion are increased substantially linearly, temperature increasing gradient of the end-portion is smaller than that of the main-portion. This indicates the fact that the heat of the end-portion is absorbed to the surrounding environment during the low temperature condition and the temperature increasing condition and, thus, the temperature of the end-portion is hard to be increased. After the image forming operation is performed at time $t_1$, when the supplying of the electric power to the respective heaters is stopped till the next image formation, the temperatures of the heaters begin to be decreased. However, during the reduction in temperature, a difference between the temperatures of the heaters is decreased. The reason is guessed that great temperature gradient is generated along the longitudinal direction of the rotary member, with the result that the heat is flows from the high temperature central portion to the low temperature end-portion, thereby making the temperature distribution uniform throughout the longitudinal direction of the rotary member. When the temperature increasing operation is performed again at time $t_2$, although the temperatures of both of the main-portion and the end-portion are increased, in comparison with the temperature increasing operation from the low temperature condition, there are differences that the temperature increasing gradient at the end-portion becomes great and that the temperature difference between both portions is small at a time when the temperature increasing operation is performed at time $t_3$. Incidentally, the former can be understood by comparing a line 1 (temperature increasing gradient of the temperature of the end-portion till the time $t_1$) with a line m (temperature increasing gradient of the temperature of the end-portion from the time $t_2$ to the time $t_3$) in FIG. 6. The reason is guessed that, in the condition that the temperature of the rotary member is already increased once such as the time $t_2$, the environment surrounding the fixing apparatus is also warmed to which the heat is hard to be absorbed. Accordingly, the temperature of the end-portion of the rotary member is apt to be increased.

Therefore, in the case where the rotary member is warmed to some extent, since the surrounding environment is also warmed, the heat is hard to be discharged from the end-portion of the rotary member. Thus, the temperature difference between the end-portion and the main-portion becomes small and the heat transferring amount from the main-portion to the end-portion is reduced. Namely, in comparison with the case where the rotary member is cold, the heat generated by the main-heater is apt to be supplied to the main-portion and the heat generated by the sub-heater is apt to be supplied to the end-portion.

In the illustrated embodiment, when the rotary member is warmed to some extent, i.e. when the initial temperature is greater than the predetermined temperature (120° C.), in the pre-heating operation, the control circuit sets the image formation permitting temperature $T_{SH-M}$ (main-portion target temperature) for the thermo-pile 5*c* to 175° C. and the image formation permitting temperature $T_{SH-S}$ (end portion target temperature) for the thermistor 5*d* to 150° C. By such setting, since the rotary member can be warmed efficiently, the pre-heating operation time is not extended excessively.

However, as mentioned above, when the temperature of the rotary member is low, since the surrounding environment is also cold, the temperature of the end-portion of the rotary member is hard to be increased in comparison with the main-portion. Thus, in the condition that the environment surrounding the fixing apparatus is cold, when the pre-heating operation is performed after the initial temperature is set to the same target temperature as the target temperature set when the initial temperature is greater than the predetermined temperature (120° C.), regardless of the fact that the temperature of the main-portion has already reached the image formation permitting temperature $T_{SH-M}$, since a time period during which the temperature of the end-portion reaches the image formation permitting temperature $T_{SH-S}$ is long, the pre-heating operation time is extended consequently.

Thus, in the illustrated embodiment, when the rotary member is cold i.e. when the initial temperature is below the predetermined temperature (120° C.), in the pre-heating operation, the control circuit sets the image formation permitting temperature $T_{SH-M}$ (main-portion target temperature) for the thermo-pile 5*c* to 190° C. and the image formation permitting temperature $T_{SH-S}$ (end portion target temperature) for the thermistor 5*d* to 140° C. If there is the temperature gradient along the longitudinal direction of the rotary member, the heat dispersed from the high temperature side to the low temperature side. By such setting, although the sub-heater is turned OFF before the temperature of the end-portion of the rotary member reaches a temperature required for the fixing operation, the insufficient heat amount can be collected from the main-portion in which the heat is apt to be increased. As a result, the pre-heating operation time can be reduced.

In the case where the initial temperature is greater than the predetermined temperature (120° C.), if the pre-heating operation is performed in the condition that the image formation permitting temperature $T_{SH-M}$ (main-portion target temperature) for the thermo-pile 5*c* is set to 190° C. and the image formation permitting temperature $T_{SH-S}$ (end portion target temperature) for the thermistor 5*d* is set to 140° C., the temperature of the main-portion becomes too high because the heat cannot be escaped, with the result that, as the case may be, hot offset may be generated. In the case where the image formation permitting temperature $T_{SH-M}$ (main-portion target temperature) for the thermo-pile 5*c* is set to 175° C. and the image formation permitting temperature $T_{SH-S}$ (end portion target temperature) for the thermistor 5*d* is set to 150° C., since the main-heater for heating the main-portion can be turned OFF at an earlier stage, the hot offset can be prevented from generating. Further, although the heat transferring amount from the main-portion to the end-portion is more reduced in the case where the initial temperature is greater than the predetermined temperature in comparison with the case where the initial temperature is below the predetermined temperature, since the target temperature of the end-portion is set to 150° C. from 140° C., the poor fixing due to the insufficient heat amount at the end-portion can be prevented.

Figure 7:
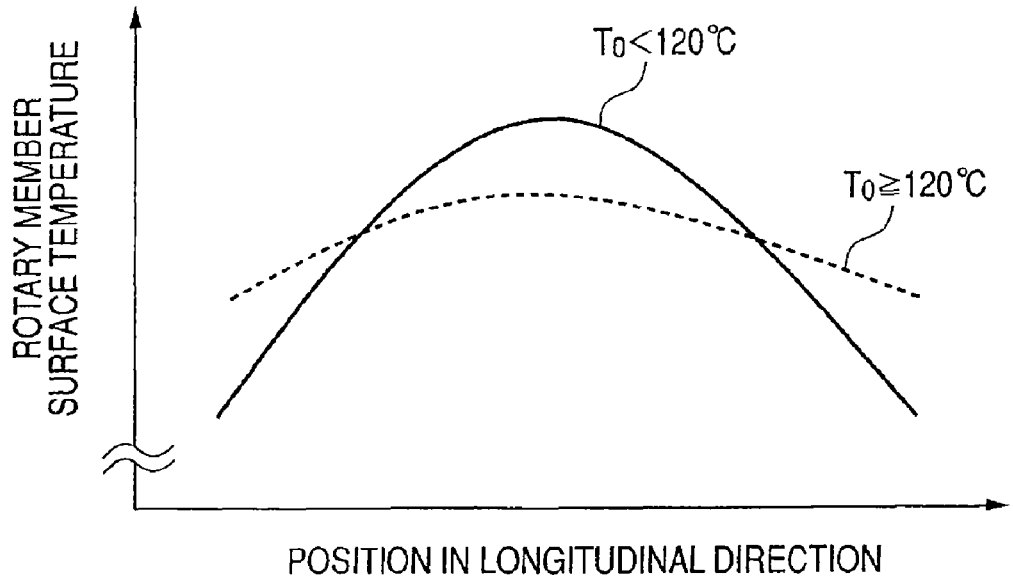
FIG. 7 is a view showing temperature distribution of the rotary member at the time when a pre-heating operation time is elapsed, in a case where an initial temperature is below 120° C. and the initial temperature is greater than 120° C. in the first embodiment of the present invention.

FIG. 7 shows temperature distribution of the surface of the rotary member at the time when the pre-heating operation time is elapsed in the case where the initial temperature is below 120° C. and in the case where the initial temperature is greater than 120° C.

Figure 8:
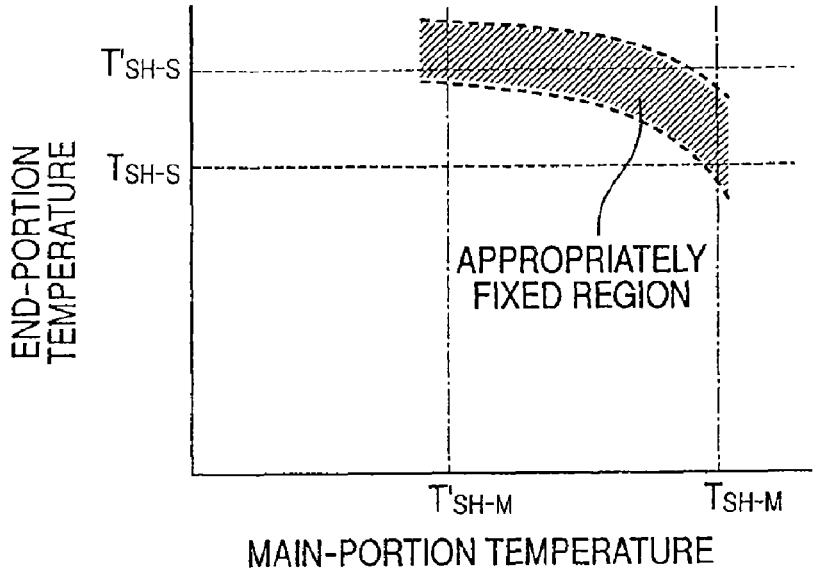
FIG. 8 is a view showing appropriately fixed regions for a main-portion temperature and an end-portion temperature in the first embodiment of the present invention.

FIG. 8 indicates a region (described as "appropriately fixed region" in FIG. 8) where the hot offset and the poor fixing are not generated, in a combination of the image formation permitting temperature $T_{SH-M}$ (main-portion target temperature) and the image formation permitting temperature $T_{SH-S}$ (end portion target temperature). It can be seen that, when the temperature of the main-portion is high, the temperature of the end-portion can be set to be low, and, the temperature of the end-portion is high, the temperature of the main-portion can be set to be low.

(5) Comparative Example

In the illustrated embodiment, the fixing apparatus is designed so that the image formation permitting temperatures for the temperature detection portions for detecting the temperatures at the different regions are altered as mentioned above, in accordance with the initial temperature $T_0$ of the main-portion of the rotary member and that the heaters capable of being driven independently on the basis of the detected temperatures of the respective temperature detection portions are used.

As a comparative example regarding the above-mentioned arrangement, a case (comparative example 1) where the image formation permitting temperature (target temperature) of the end-portion is not altered in the step S201 described with reference to FIG. 5 i.e. a case where the setting of the image formation permitting temperature $T_{SH-S}$ (end portion target temperature) is not altered regardless of the initial temperature $T_0$ and, a case (comparative example 2) of a fixing apparatus using a single heater (having an output of 1200 W) having uniform heat generation distribution in place of the above-mentioned heaters were tested. In both cases, during the low temperature i.e. when the initial temperature is below 120° C., it could be ascertained that the result of the image forming operation utilizing the pre-heating operation from 25° C. (room temperature) does not generate the hot offset and the poor fixing similarly.

During the high temperature i.e. when the initial temperature is greater than 120° C., a result of the image forming operation utilizing the pre-heating from the condition that the thermo-pile 5*c* detects 120° C. was examined.

As shown in the following Table 1, in the illustrated embodiment, it can be understood that, even when the initial temperature is high, the hot offset and the poor fixing are not generated and the heat is supplied to the recording material properly ("FAIR" in the Table 1). On the other hand, in the comparative example 1, since the image formation starting temperature of the end-portion is set to be low, the heat from the main-portion could not be expected to be supplied to the end-portion thereby to cause the poor heat supplying at the end-portion, which generated the poor fixing ("FAIL" in the Table 1). Further, in the comparative example 2, when the image forming temperature of the end-portion was set again to be high, due to the high temperature of the end-portion, the main-portion also continued to be heated during the image formation preparing operation, with the result that excessive heat was supplied to the main-portion, thereby generating the hot offset ("FAIL" in the Table 1).

TABLE 1

| | Hot offset | | Poor fixing | |
|---|---|---|---|---|
| | Main-portion | End-portion | Main-portion | End-portion |
| Embodiment 1 | FAIR | FAIR | FAIR | FAIR |
| Comparative example 1 | FAIR | FAIR | FAIR | FAIL |
| Comparative example 2 | FAIL | FAIR | FAIR | FAIR |

Further, as a comparative example 3, a case where the image formation permitting temperature of the end-portion is previously set to be high (150° C.) was also examined. In the comparative example 3, although the problems regarding the hot offset and the poor fixing were solved, since it is required to wait the increase in the temperature of the end-portion also in the image forming preparation from the low temperature, an unfavorable result that the pre-heating operation time was extended by four minutes or more was found.

As mentioned above, in the illustrated embodiment, excellent results that the hot offset and the poor fixing from the high temperature can be prevented and that the pre-heating operation time from the low temperature can be reduced were obtained.

Next, the comparison was carried out, while paying attention to the changing or switching of the image formation permitting temperature in accordance with the initial temperature.

In a comparative example 4, the image formation permitting temperature $T_{SH-M}$ (main-portion target temperature) for the thermo-pile 5*c* was always set to 190° C. and the image formation permitting temperature $T_{SH-S}$ (end-portion target temperature) for the thermistor 5*d* was always set to 140° C., regardless of the initial temperature $T_0$.

In a comparative example 5, the image formation permitting temperature $T_{SH-M}$ (main-portion target temperature) for the thermo-pile 5*c* was always set to 175° C. and the image formation permitting temperature $T_{SH-S}$ (end-portion target temperature) for the thermistor 5*d* was always set to 150° C., regardless of the initial temperature $T_0$.

In a comparative example 6, when the initial temperature $T_0$ is below 120° C. (predetermined temperature), the image formation permitting temperature $T_{SH-M}$ (main-portion target temperature) for the thermo-pile 5*c* is set to 175° C. and the image formation permitting temperature $T_{SH-S}$ (end-portion target temperature) for the thermistor 5*d* is set to 160° C. On the other hand, when the initial temperature $T_0$ is greater than 120° C., the image formation permitting temperature $T_{SH-M}$ (main-portion target temperature) for the thermo-pile 5*a* is set to 175° C. and the image formation permitting temperature $T_{SH-S}$ (end-portion target temperature) for the thermistor 5*b* is set to 150° C.

In a comparative example 7, when the initial temperature $T_0$ is below 120° C. (predetermined temperature), the image formation permitting temperature $T_{SH-M}$ (main-portion target temperature) for the thermo-pile 5*c* is set to 180° C. and the image formation permitting temperature $T_{SH-S}$ (end-portion target temperature) for the thermistor 5*d* is set to 180° C. On the other hand, when the initial temperature $T_0$ is greater than 120° C., the image formation permitting temperature $T_{SH-M}$ (main-portion target temperature) for the thermo-pile 5*a* is set to 180° C. and the image formation permitting temperature $T_{SH-S}$ (end-portion target temperature) for the thermistor 5*b* is set to 180° C.

Results are shown in the following Table 2. A case where the hot offset and the poor fixing are not generated is represented by "FAIR", and a case where the hot offset and/or the poor fixing are generated is represented by "FAIL".

Regarding the pre-heating operation time, a case where the time is extended by four minutes or more is represented by "FAIL".

TABLE 2

| | $T_0 < 120°$ C. | | $120° C. \leqq T_0$ | | Hot offset | Pre-heating operation time |
|---|---|---|---|---|---|---|
| | main portion (° C.) | end portion (° C.) | main portion (° C.) | end portion (° C.) | Poor fixing | |
| Embodiment 1 | 190 | 140 | 175 | 150 | FAIR | FAIR |
| Comparative example 4 | 190 | 140 | 190 | 140 | FAIL | FAIR |
| Comparative example 5 | 175 | 150 | 175 | 150 | FAIR | FAIL |
| Comparative example 6 | 175 | 160 | 175 | 150 | FAIR | FAIL |
| Comparative example 7 | 180 | 180 | 180 | 180 | FAIL | FAIL |

In the embodiment 1, the hot offset and the poor fixing are prevented and the pre-heating operation time is optimum.

In the comparative example 4, although the pre-heating operation time was optimum regardless of the initial temperature, when the initial temperature is greater than 120° C., the hot offset might be generated.

In the comparative example 5, although the generation of the hot offset and the poor fixing could be suppressed, when the initial temperature is below 120° C., the pre-heating operation time was evaluated as "FAIL".

Also in the comparative example 6, when the initial temperature is below 120° C., the pre-heating operation time was evaluated as "FAIL". When the initial temperature is below 120° C., the pre-heating operation time was longer than that in the comparative example 5.

In the comparative example 7, the generation of the hot offset and the poor fixing might not be suppressed. Further, when the initial temperature is below 120° C., the pre-heating operation time was evaluated as "FAIL".

As mentioned above, it can be understood that the fixing apparatus according to the embodiment 1 is a fixing apparatus in which the poor fixing and the hot offset are not generated regardless of the initial temperature of the rotary member and the pre-heating operation time is not extended excessively.

Figure 9:
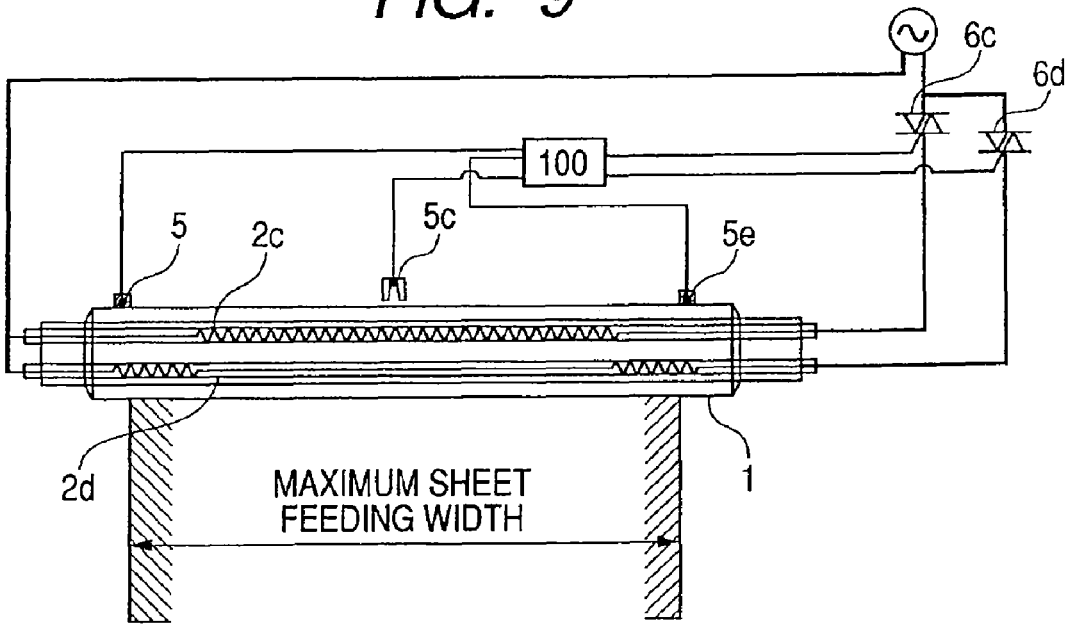
FIG. 9 is a schematic view showing a relationship between longitudinal heaters and plural temperature detection portions of the fixing apparatus according to the first embodiment of the present invention.

Incidentally, an arrangement in which a plurality of second temperature detection portions is disposed in the non-sheet-feeding regions may be adopted. In FIG. 9, a thermistor 5*d* for detecting the temperature of one end-region of the fixing roller 1 and a thermistor 5*e* for detecting the temperature of the other end-region of the fixing roller 1 are provided. The thermistor 5*d* and the thermistor 5*e* are connected to the control circuit 100 via signal lines, respectively and are fundamentally referred to control for the sub-heater 2*c*. In the pre-heating operation, when both of the thermistor 5*d* and the thermistor 5*e* reach their target temperatures, the electrifying to the sub-heater 2*c* is stopped. With this arrangement, the poor fixing at the end-portions of the rotary member can be suppressed more positively.

Embodiment 2

Figure 10:
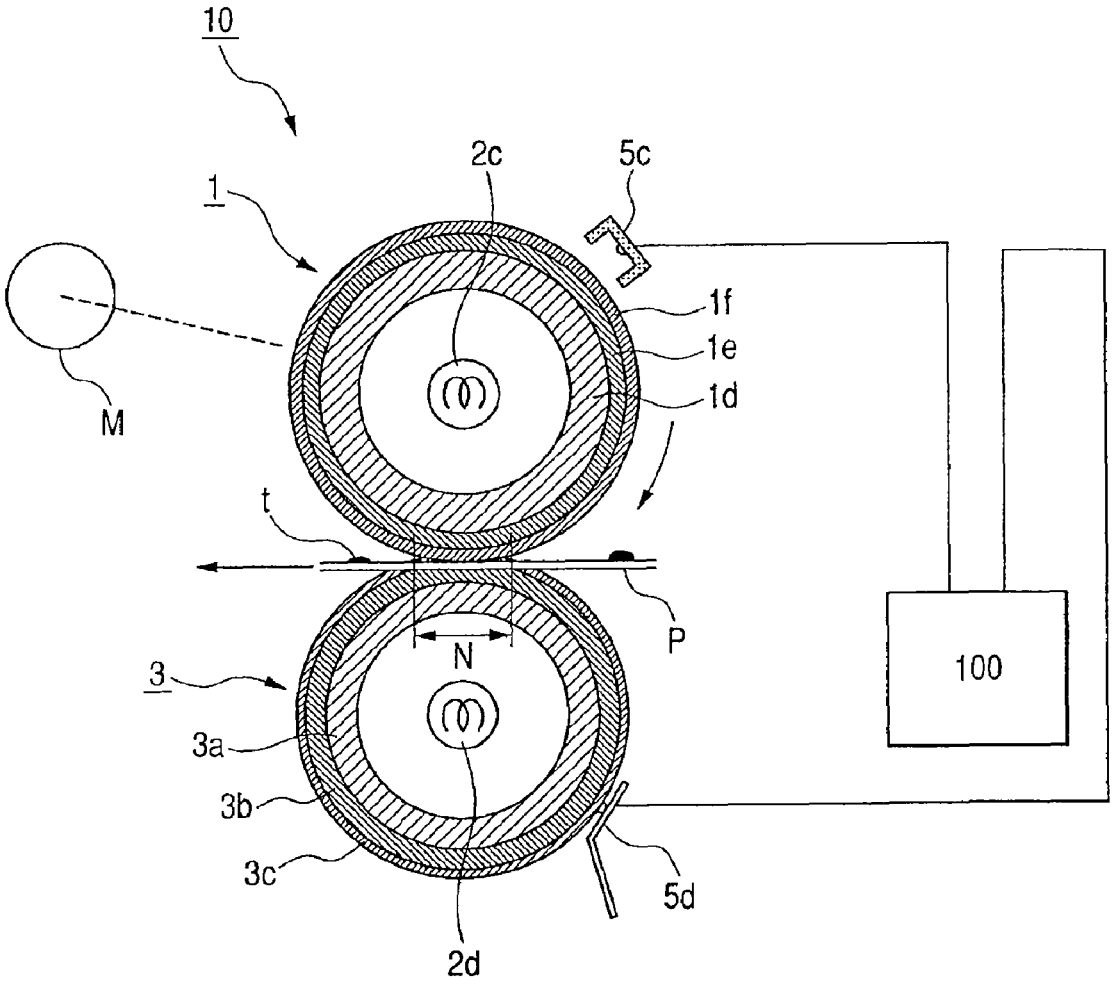
FIG. 10 is a side model view, in partial section, of a fixing apparatus according to a second embodiment of the present invention.

A fixing apparatus according to an embodiment 2 is substantially the same as that of the embodiment 1, except for the fact that a fixing apparatus 10 shown in FIG. 10 is used and that the image formation permitting temperatures (target temperatures) corresponding to those of the fixing apparatus 10 of FIG. 8 are set. Thus, the embodiment 2 will be described by using the reference numerals and the like utilized in the above-mentioned explanation.

(1) Fixing Apparatus 10 (FIG. 8)

Regarding a fixing roller 1 as a rotary member, silicone rubber having a thickness of 2.1 mm (and having heat transfer coefficient of 0.6 W/m/K) is coated on a hollow metal core 1*d* made of iron and having a thickness of 1.5 mm to form an elastic layer 1*e*, and a tube comprised of PFA resin having a thickness of 50 μm is provided on the elastic layer, thereby obtaining the fixing roller having a diameter of 50 mm. A pressure roller 3 as another rotary member is urged against the fixing roller 1 with pressure of about 700 N, thereby forming the fixing nip portion N therebetween. Regarding the pressure roller 3, silicone rubber having a thickness of 2.1 mm (and having heat transfer coefficient of 0.6 W/m/K) is coated on a hollow iron metal core 3*a* having a diameter of 50 mm to form an elastic layer 3*b*, and a surface layer 3*c* is formed by a PFA tube having a thickness of 50 μm.

The fixing roller 1 and the pressure roller 3 include halogen heaters as heaters therein, and, in this case, a main-heater 2*c* (heater other than auxiliary heat sources) is a heater having an output of 900 W and designed to have uniform heat generation distribution in a whole area of a sheet-feeding region in order to heat the fixing roller 1. In the illustrated embodiment, a roller having a large heat capacity is used, and a heater having a great output is used as the main-heater 2*c* to reduce a pre-heating operation time. A sub-heater (auxiliary heater) 2*d* is a heater having an output of 400 W and designed to afford 90% of a heat generation amount to regions having a width of 70 mm at both end-portions and mainly serves to heat end-portions of the pressure roller 3. These heaters can be driven independently and outputs thereof are adjusted by a control circuit 100.

A thermo-pile (first temperature detection portion) 5*c* as a first temperature sensor serves to detect the temperature of the main-portion of the fixing roller 1 and is disposed in a confronting relationship to the fixing roller 1 in a non-contact condition. A thermistor (second temperature detection portion) 5*d* as a second temperature sensor serves to detect the temperatures of the end-portions of the fixing roller 1 and abuts against the pressure roller 3 at regions outside of the maximum width of the recording material P which can be fed. The thermo-pile 5*c* and the thermistor 5*d* are connected to the control circuit 100 via signal lines, respectively, and, fundamentally, the thermo-pile 5*c* is referred to control for the main-heater 2*c* and the thermistor 5*d* is referred to control for the sub-heater 2*d*. Incidentally, the recording material is denoted by P, a drive motor (drive means) for driving the fixing roller 1 is denoted by M, and toner is denoted by t.

Figure 11:
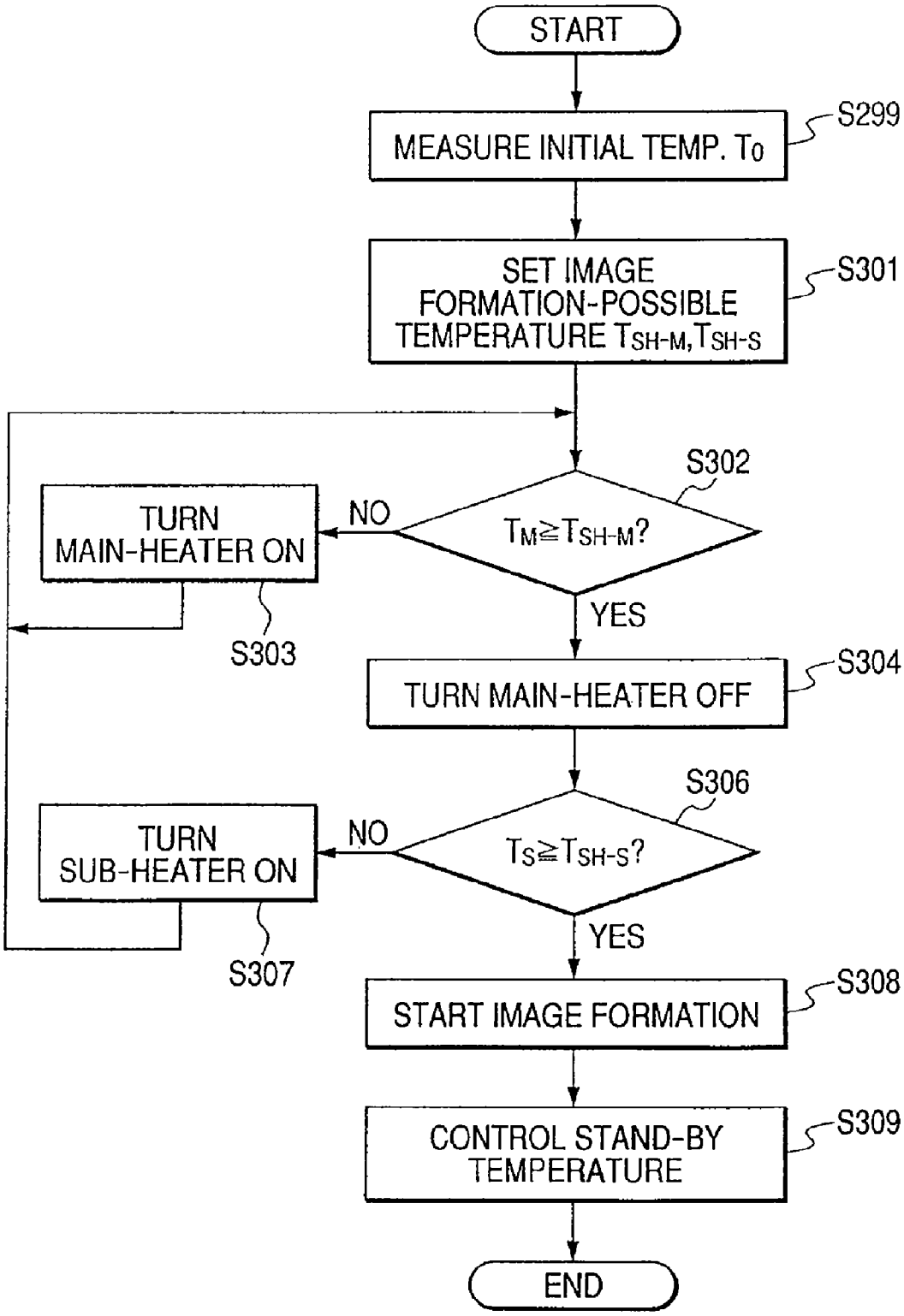
FIG. 11 is a flow chart for explaining an image formation preparing sequence according to the second embodiment of the present invention.

(2) Image Forming Preparation (FIG. 11)

Also in this embodiment, similar to the embodiment 1, after the image forming preparation is carried out, the stand-by temperature adjustment is performed as a basic operation. In the stand-by temperature adjustment, the fixing roller 1 is maintained to a substantially uniform temperature; whereas, in the pre-heating operation during the image forming preparation, by operating the sub-heater 2*d*, the wait time is reduced and the poor fixing at the end-portions is prevented.

Further, in order to reflect the temperatures of the end-portions of the fixing roller 1 to the detected temperature of the thermistor 5*d*, the fixing roller 1 is rotated at a predetermined speed during the image forming preparation, thereby maintaining the heat transferring to the pressure roller 3.

FIG. 11 is a flow chart showing the pore-heating operation for the image forming preparation. Before the image forming preparation is started, an initial temperature $T_0$ is measured by the thermo-pile 5*c* (step S299; hereinafter, "step" is omitted), and, on the basis of the initial temperature $T_0$, image formation permitting temperatures (target temperatures) for the thermo-pile 5*c* and the thermistor 5*d* are set, respectively (S301). Concretely, if the initial temperature $T_0$ is below 120° C. (predetermined temperature), an image formation permitting temperature $T_{SH-M}$ (main-portion image formation permitting temperature) for the thermo-pile 5*c* is set to 190° C. and an image formation permitting temperature $T_{SH-S}$ (end-portion image formation permitting temperature) for the thermistor 5*d* is set to 140° C. On the other hand, if the initial temperature $T_0$ is greater than 120° C., the image formation permitting temperature $T_{SH-M}$ for the thermo-pile 5*a* is set to 175° C. and the image formation permitting temperature $T_{SH-S}$ for the thermistor 5*b* is set to 150° C.

If the detected temperature $T_M$ of the main-heater 2*c* detected by the thermo-pile 5*c* is below the image formation permitting temperature $T_{SH-M}$ (No in S302), the main-heater 2*c* is turned ON (S303). Then, when the detected temperature $T_M$ of the thermo-pile 5*c* reaches the image formation permitting temperature $T_{SH-M}$ (Yes in S302), the output of the main-heater 2*c* is stopped (OFF) (S304). Then, until the detected temperature $T_S$ of the sub-heater 2*d* detected by the thermistor 5*d* reaches the image formation permitting temperature $T_{SH-S}$ (No in S306), the sub-heater 2*d* is maintained to ON (S307), thereby continuing the image formation preparing operation. At a time when the detected temperatures of the thermo-pile 5*c* and the thermistor 5*d* reach the image formation permitting temperatures, respectively (Yes in S306), the image formation is started (S308), and, after the image formation is finished, stand-by temperature adjustment is performed (S309). In this embodiment, as long as the pre-heating operation is finished at each time when each of the temperatures of the thermo-pile 5*c* and the thermistor 5*d* respectively reaches each of the image formation permitting temperatures, the requirement is satisfied. That is, the flow sequence of the pre-heating operation in this embodiment is not restricted to the flow disclosed in FIG. 11.

The image forming preparation is performed not only upon ON of the power source but also at a restoring operation after jam treatment and/or replacement of a worn part such as the photosensitive drum. In the restoring operation, if the rotary member already had the high temperature, the image formation permitting temperatures are set again in S301.

In the embodiment 2, the same effect as the embodiment 1 can be obtained, and at the same time, the temperature of the pressure roller 3 can be managed positively, and the heat amounts applied to the front and rear surfaces of the recording material can easily be controlled, thereby preventing deformation such as curl.

Embodiment 3

A fixing apparatus according to an embodiment 3 is the same as that of the embodiment 1, except for the fact that silicone rubber having high heat transfer coefficient (0.8 W/m/K) is used in the elastic layer 1*e* of the fixing roller 1 of the fixing apparatus shown in FIG. 2. Thus, the embodiment 3 will be described by using the same reference numerals as those in the embodiment 2 so long as the same reference numerals can be used.

In the image forming preparation according to the embodiment 3, as the optimum image formation permitting temperature in the step S201 of FIG. 5, if the initial temperature $T_0$ is below 120° C., the image formation permitting temperature $T_{SH\text{-}M}$ is set to 180° C. and the image formation permitting temperature $T_{SH\text{-}S}$ is set to 120° C. On the other hand, if the initial temperature $T_0$ is greater than 120° C., by setting the image formation permitting temperature $T_{SH\text{-}M}$ to 175° C. and the image formation permitting temperature $T_{SH\text{-}S}$ to 150° C., generation of the hot offset and the poor fixing can be prevented.

In comparison with the embodiment 1, such setting has advantages that, if the initial temperature $T_0$ is below 120° C., the image formation permitting temperatures $T_{SH\text{-}M}$ and $T_{SH\text{-}S}$ can be lowered and that the pre-heating operation time can be reduced.

In order to examine what the setting is based upon, a relationship between the main-portion temperature and the end-portion temperature, which does not generate the poor fixing, was tested by changing the thickness and heat transfer coefficient of the silicone rubber. A test result is shown in FIG. 12.

Figure 12:
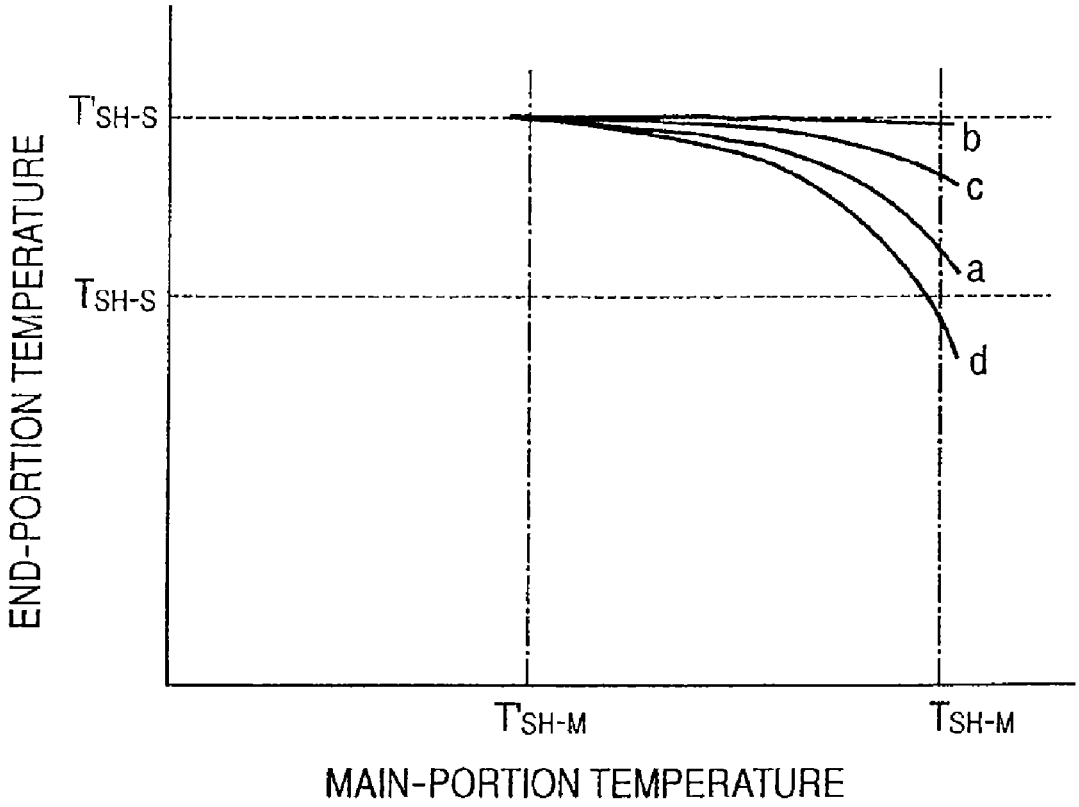
FIG. 12 is a view showing a result of tests performed to examine a relationship between a main-portion temperature and an end-portion temperature, which does not generate poor fixing, by changing a thickness and heat transfer coefficient.

Here, in FIG. 12, a denotes an elastic layer having a thickness of 2 mm made of silicone rubber having heat transfer coefficient of 0.6 W/m/K; and, b denotes an elastic layer having a thickness of 1 mm made of silicone rubber having heat transfer coefficient of 0.4 W/m/K. On the other hand, in FIG. 12, c denotes an elastic layer having a thickness of 0.3 mm made of silicone rubber having heat transfer coefficient of 1.6 W/m/K; and, d denotes an elastic layer having a thickness of 2 mm made of silicone rubber having heat transfer coefficient of 0.8 W/m/K, which has a construction similar to the illustrated embodiment.

Considering the result shown in FIG. 12, in accordance with a value obtained by multiplying the thickness L of the elastic layer by the heat transfer coefficient λ, if the temperature of the main-portion was increased, it was found that tendency capable of decreasing the temperature of the end-portion was strengthened. Further, when $L \cdot \lambda$ was greater than $4\times10^{-4}$ W/K, it was ascertained that heat compensation from the main-portion to the end-portion was achieved.

On the basis of the above-mentioned consideration, in the illustrated embodiment, since a greater value of $L \cdot \lambda$ can be obtained, if the initial temperature T is below 120° C., much heat from the main-portion to the end-portion is apt to be maintained, and the pre-heat operation time can be more reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2007-195825, filed Jul. 27, 2007, and No. 2008-181505, filed Jul. 11, 2008, which are hereby incorporated by reference herein in their entirety.

What is claimed is:

1. An image fixing apparatus for fixing an image formed on a recording material, comprising:

a rotary member that contacts with a recording material bearing an image;

a first heater provided in said rotary member, wherein a heat generation amount per unit length at a central region of said first heater in a longitudinal direction is higher than a heat generation amount per unit length at end regions of said first heater in the longitudinal direction;

a second heater provided in said rotary member, wherein a heat generation amount per unit length at end regions of said second heater in a longitudinal direction is higher than a heat generation amount per unit length of said second heater at a central region in the longitudinal direction;

a pressure roller that forms a nip portion to pinch and convey the recording material with said rotary member, wherein the image on the recording material is fixed onto the recording material by heating the image at the nip portion;

a first temperature detection portion that detects a temperature of said rotary member at a longitudinal central region of said rotary member;

a second temperature detection portion that detects a temperature of said rotary member at a longitudinal end region of said rotary member; and a control circuit for controlling electrifying of said first heater and said second heater, wherein, when said apparatus starts warming up, said control circuit controls electrifying of said first heater so that the temperature detected by said first temperature detection portion reaches a first target temperature and controls electrifying of said second heater so that the temperature detected by said second temperature detection portion reaches a second target temperature; and wherein a difference between the first target temperature and the second target temperature in a case where an initial temperature of said rotary member is lower than a predetermined temperature is higher than a difference between the first target temperature and the second target temperature in a case where the initial temperature of said rotary member is higher than the predetermined temperature.

2. An image fixing apparatus according to claim 1, wherein the initial temperature of said rotary member is a temperature detected by said first temperature detection portion.

3. An image fixing apparatus according to claim 1, wherein said control circuit finishes warming up when the temperature detected by said first temperature detection portion reaches the first target temperature and the temperature detected by said second temperature detection portion reaches the second target temperature.

4. An image fixing apparatus according to claim 3, wherein a plurality of said second temperature detection portions are disposed at a longitudinal end region of said rotary member, and wherein said control circuit finishes warming up when the temperature detected by said first temperature detection portion reaches the first target temperature and the temperature detected by the second temperature detection portions reach the second target temperature.

5. An image fixing apparatus according to claim 1, wherein said rotary member has an elastic layer having a thickness of said elastic layer defined as L and a heat transfer coefficient of said elastic layer defined as λ, and wherein the thickness and the heat transfer coefficient of said elastic layer satisfies a relationship of $L \cdot \lambda \geqq 4 \times 10^{-4}$ (W/K).

6. An image fixing apparatus for fixing an image formed on a recording material, comprising:

a first rotary member that contacts with a recording material bearing an image;

a second rotary member that contacts with the recording material bearing the image, the second rotary member forms a nip portion to pinch and convey the recording material with said first rotary member;

a first heater provided in said first rotary member, wherein a heat generation amount per unit length at a central region of said first heater in a longitudinal direction is higher than a heat generation amount per unit length at end regions of said first heater in the longitudinal direction;

a second heater provided in said second rotary member, wherein a heat generation amount per unit length at end regions of said second heater in a longitudinal direction is greater than a heat generation amount per unit length of said second heater at a central region in a longitudinal direction;

wherein the image on the recording material is fixed onto the recording material by heating the image at the nip portion;

a first temperature detection portion that detects a temperature of said first rotary member at a longitudinal central region of said first rotary member;

a second temperature detection portion that detects a temperature of said second rotary member at a longitudinal end region of said second rotary member; and a control circuit for controlling electrifying of said first heater and said second heater, wherein when said apparatus starts warming up, said control circuit controls electrifying of said first heater so that the temperature detected by said first temperature detection portion reaches a first target temperature and controls electrifying of said second heater so that the temperature detected by said second temperature detection portion reaches a second target temperature; and wherein a difference between the first target temperature and the second target temperature in a case where an initial temperature of said rotary member is lower than a predetermined temperature is higher than a difference between the first target temperature and the second target temperature in a case where the initial temperature of said rotary member is higher than the predetermined temperature.

* * * * *